US005214940A

United States Patent [19]

Capifali

[11] Patent Number: 5,214,940

[45] Date of Patent: Jun. 1, 1993

[54] DETACHABLE DRESS CAP FOR LOCKS ON JEWELRY CHAINS

[76] Inventor: Vincent Capifali, 392 Mamaroneck Ave., White Plains, N.Y. 10605

[21] Appl. No.: 808,602

[22] Filed: Dec. 17, 1991

[51] Int. Cl.[5] ..... A44C 25/00

[52] U.S. Cl. ..... 63/21; 24/633; 63/2

[58] Field of Search ..... 63/2, 4, 19, 21; 24/633

[56] References Cited

U.S. PATENT DOCUMENTS

| | | | |
|---|---|---|---|
| 249,201 | 11/1881 | Oliver | 63/12 |
| D. 252,618 | 8/1979 | Barr | D11/86 |
| 1,578,940 | 3/1926 | Wacha | 63/21 |
| 2,262,548 | 11/1941 | Genser | 63/19 |
| 3,618,338 | 11/1971 | Sauer | 63/19 |
| 4,452,052 | 6/1984 | Hodge | 63/2 |
| 4,530,221 | 7/1985 | Weinberg | 63/23 |
| 4,611,368 | 9/1986 | Batterby | 63/2 |
| 4,628,708 | 12/1986 | Ivey | 63/2 |
| 4,754,534 | 7/1988 | Helwick | 63/2 |

FOREIGN PATENT DOCUMENTS

| | | | |
|---|---|---|---|
| 1160562 | 7/1958 | France | 63/19 |
| 19968 | 9/1908 | United Kingdom | 63/19 |
| 825076 | 12/1959 | United Kingdom | 63/19 |

*Primary Examiner*—Peter M. Cuomo
*Assistant Examiner*—Michael Milano
*Attorney, Agent, or Firm*—Kane, Dalsimer, Sullivan, Kurucz, Levy, Eisele and Richard

[57] ABSTRACT

The dress cap is a releasably detachable cap for covering the lock of a jewelry chain, particularly a necklace or bracelet, so as to conceal the lock. The dress cap includes two hinged portions and a latch between the two hinged portions, wherein at least one of the portions includes a concave surface for encompassing the lock. Many variations of the dress cap and latches are possible.

20 Claims, 2 Drawing Sheets

FIG. 1
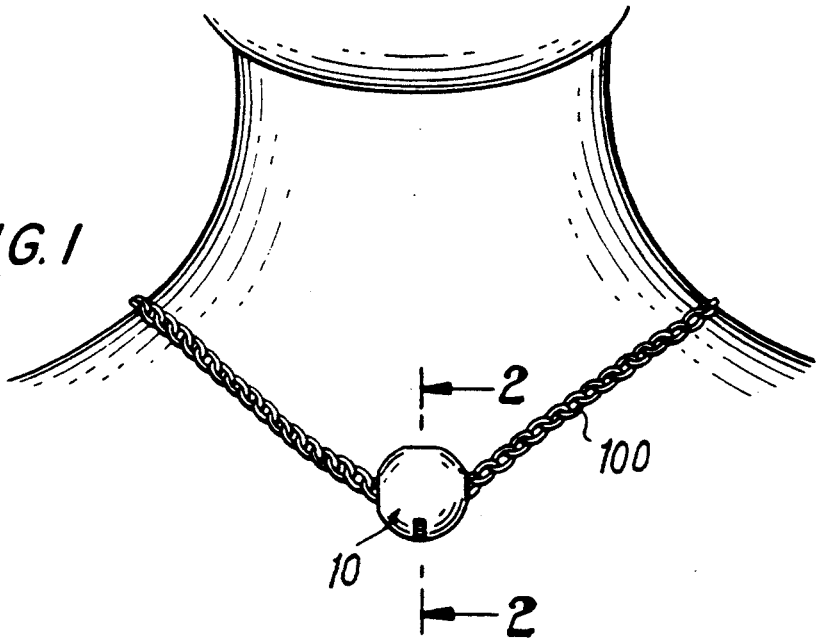
FIG. 2
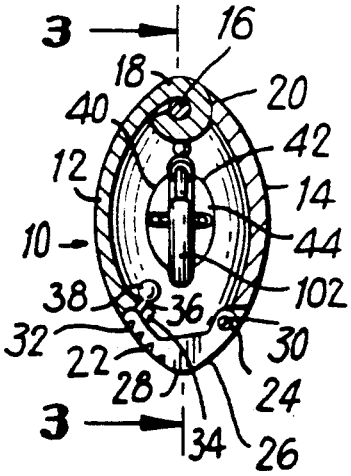
FIG. 3
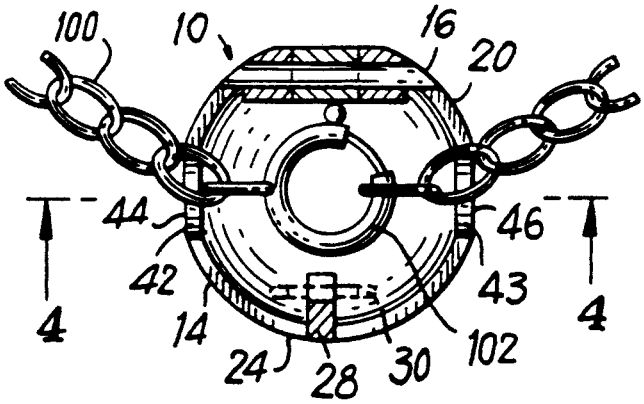
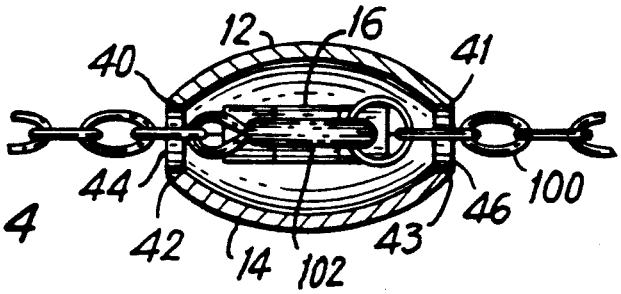
FIG. 4

FIG. 5
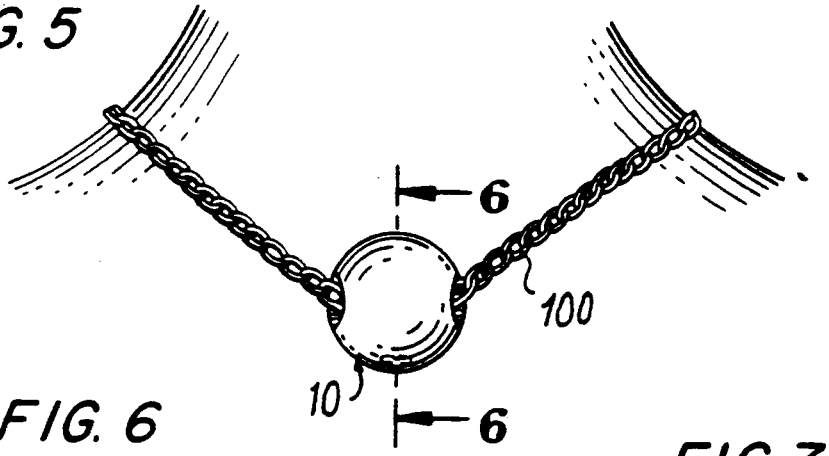
FIG. 6
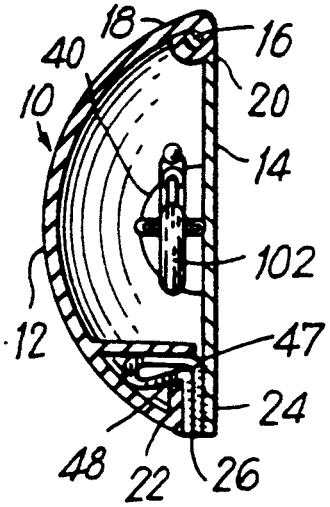
FIG. 7
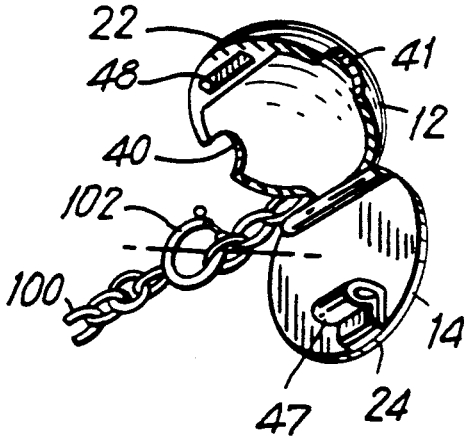
FIG. 8
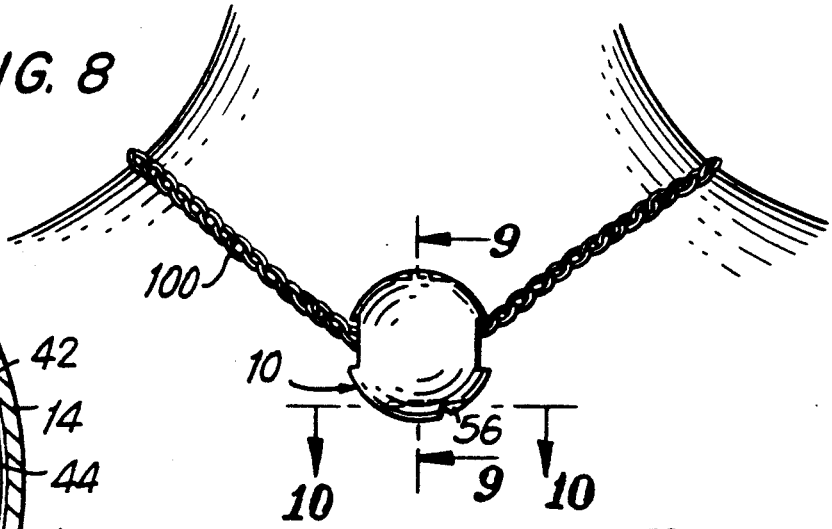
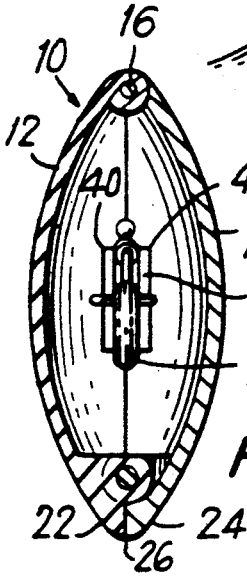
FIG. 9
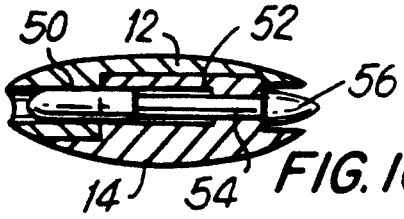
FIG. 10

DETACHABLE DRESS CAP FOR LOCKS ON JEWELRY CHAINS

BACKGROUND OF THE INVENTION

1. Field of the Invention

This invention pertains to a detachable fixture or "dress cap" for concealing the lock on jewelry chains, particularly necklaces and bracelets.

2. Description of the Prior Art

Jewelry chains, particularly unadorned gold, gold-like or other precious metal necklaces and bracelets, have become popular jewelry items for both sexes. However, the typical lock which is an integral part of these chains has presented an aesthetic deficiency by frequently rotating around the neck, wrist or other bodily part to a visible position, particularly if the lock was heavier than an equivalent length of chain. This has presented a problem for the meticulous jewelry wearer who therefore is frequently required to rotate the jewelry chain until the lock is not visible.

While the prior art includes components integral to the piece of jewelry, particularly adorned necklaces, to make the lock more pleasing, this has not solved the problem of the jewelry wearer who owns several chains or wants variety in the appearance of the chain.

U.S. Pat. No. Des. 252,618 discloses a hinged jacket for rings, but has not solved the above problems for chains.

OBJECTS AND SUMMARY OF THE INVENTION

It is therefore an object of this invention to conceal the lock of a piece of chain jewelry, particularly unadorned necklaces and bracelets, regardless of how the piece of jewelry rotates upon the user's body.

It is therefore a further object of this invention to provide a detachable element to conceal the lock of a piece of chain jewelry, particularly unadorned necklaces and bracelets.

It is therefore a still further object of this invention to provide an interchangeable element to conceal the lock of a piece of chain jewelry, particularly unadorned necklaces and bracelets.

These and other objects are attained by providing an apparatus with two clamshell, hemispheric-like or similar halves including hinge means therebetween on a first end to allow the lock of a jewelry chain to be inserted between the two halves. Further, the apparatus includes latch means on a second end to allow the halves to be brought together and latched to releasably and detachably secure the apparatus to the lock. Moreover, the halves include indentations along the sides thereof to form apertures when the halves are latched together so as to allow the jewelry chain but not the lock to pass therethrough.

BRIEF DESCRIPTION OF THE DRAWINGS

Further objects and advantages of the invention will become apparent from the following description and claims, and from the accompanying drawings, wherein:

FIG. 1 is a perspective view a first embodiment of the present invention attached to a necklace chain around the neck of the wearer.

FIG. 2 is a cross-sectional view of the first embodiment of the present invention along plane 2—2 of FIG. 1.

FIG. 3 is a cross-sectional view of the first embodiment of the present invention along plane 3—3 of FIG. 2.

FIG. 4 is a cross-sectional view of the first embodiment of the present invention along plane 4—4 of FIG. 3.

FIG. 5 is a perspective view, partly in phantom, of a second embodiment of the present invention attached to a necklace chain around the neck of the wearer.

FIG. 6 is a cross-sectional view of the second embodiment of the present invention along plane 6—6 of FIG. 5.

FIG. 7 is a perspective view of the second embodiment of the present invention with the halves hingedly extended apart for engaging a lock of a chain.

FIG. 8 is a perspective view, partly in phantom, of the third embodiment of the present invention attached to a necklace chain around the neck of the wearer.

FIG. 9 is a cross-sectional view of the third embodiment of the present invention along plane 9—9 of FIG. 8.

FIG. 10 is a cross-sectional view of the third embodiment of the present invention along plane 10—10 of FIG. 8.

DETAILED DESCRIPTION OF THE PREFERRED EMBODIMENT

Referring now to the drawings in detail wherein like numerals refer to like elements throughout the several views, one can see that FIG. 1 is a perspective view of a user with a jewelry chain 100 around his or her neck. Although the drawings illustrate the application of the present invention to a necklace, it should be understood that this invention is equally applicable to bracelets or other jewelry chains. A first embodiment of dress cap 10, shown in its closed position in FIG. 1, covers and conceals lock 102 (see FIG. 3). Dress cap 10 typically has a surface finish to match the metal and finish of the jewelry chain 100 and therefore may be a gold alloy, gold filled, gold plated, gold tone or other similar precious or non-precious metal.

As shown in FIG. 2, dress cap 10 includes halves 12 and 14 with a hinge means 16 hingeably engaging a first end 18 of half 12 to a first end 20 of half 14. In this embodiment, halves 12 and 14 are both portions of a hemisphere or clamshell-shaped and relatively symmetric with each other. Hinge means 16 allows halves 12 and 14 to move between a closed position around the lock 102 and an open position (such as is shown in FIG. 7) to allow lock 102 to be inserted therein.

Second end 22 of half 12 and second end 24 of half 14 include latch means 26 to allow halves 12 and 14 to be detachably secured to each other (around lock 102) thereby securing dress cap 10 to chain 100. As shown in FIG. 1, latch means 26 of the first embodiment includes a male portion 28 attached to second end 24 of half 14 by pivot means 30. Male portion 28 extends into slot 32 on second end 24 of half 14. Slot 32 further includes a bridge 34 across an inward portion thereof thereby forming aperture 36 which acts as a detent means. Male portion 28 preferably includes knurls 32 to allow the user to more easily pivot male portion 28. The distal end of male portion 28 further includes a bulbous protrusion 38 at an angle thereto which engages aperture 36 to act as part of the detent means and latch half 12 to half 14.

As shown in FIGS. 3 and 4, half 12 includes lateral indentations 40 and 41, while half 14 includes lateral indentations 42 and 43. When halves 12 and 14 are latched together, lateral indentations 40 and 42 align thereby forming aperture 44. Similarly, lateral indentations 41 and 43 align thereby forming aperture 46. Chain 100 passes through apertures 44 and 46. It should be noted that apertures 44 and 46 are large enough to allow chain 100 to pass therethrough, but are small enough that lock 102 will not pass therethrough. Therefore, in the embodiment illustrated in FIGS. 1–4, if lock 102 were to become accidentally unhooked while dress cap 10 was attached thereto, dress cap 10 would remain attached to lock 102 but the portion of chain 100 not including lock 102 as illustrated would pass freely out of aperture 44 or 46.

A second embodiment of dress cap 10 is illustrated in FIGS. 5–7. Half 14 is a flat plate and half 12 is a somewhat greater portion of a hemisphere in this embodiment than in the previously described first embodiment. Similarly, lateral indentations 40, 41 are somewhat deeper as half (plate) 14 includes no such lateral indentations. Moreover, latching means 26 is somewhat simplified by including a detent tab 47 on second end 24 of half (plate) 14 and a corresponding detent notch 48 on second end 22 of half 12. The flat plate shape of half 14 has the advantage of making more contact with the wearer's body and therefore not sliding as easily. However, the user may wish to keep the curved shape of half 12 exposed for aesthetic reasons.

A third embodiment of dress cap 10 is illustrated in FIGS. 8–10. This embodiment includes rectangular shaped lateral indentations 40, 41, 42 and 43 (40 and 42 being shown in FIG. 9. Additionally, latching means 26 includes offset channels 50, 52 in halves 12, 14 respectively, which align when halves 12, 14 are engaged against each other. Channel 52 includes a post 54 with an enlarged exposed end 56. Post 54 has some longitudinal "play" within channel 52, allowing the user to engage enlarged exposed end with a fingernail, pull the post 54, align channel 52 with channel 50 and push post 54 so as to engage channel 50 thereby latching halves 12 and 14 to each other.

To use dress cap 10, the user puts on jewelry chain 100 and fasten lock 102 in the usual fashion. The user then disengages latch means 26 and spreads half 12 away from half 14. The user then places lock 102 within halves 12 and 14 so that the chain 100 passes through apertures 44 and 46. The user then engages half 12 against half 14 and engages latching means 26 in the usual fashion. The user can now wear his or her chains without the trouble and hassle of worrying whether or not the lock is exposed. Additionally, the dress cap 10 adds to the elegance of chain 10.

Dress cap 10 can come in a wide variety of shapes, sizes and finishes.

Thus the several aforementioned objects and advantages are most effectively attained. Although preferred embodiments of the invention has been disclosed and described in detail herein, it should be understood that this invention is in no sense limited thereby and its scope is to be determined by that of the appended claims.

What is claimed is:

1. A cap for concealing a lock of jewelry chain comprising:

a first and a second portion, wherein at least one portion includes a concave element for encompassing and concealing the lock of a jewelry chain;

hinge means hingeably attaching a first end of said first and second portions together whereby said cap is releasably detachable from the lock on the jewelry chain;

latch means on a second end of said first and second portions for latching said first and second portions together; and at least one of said first and second portions including indentations whereby first and second apertures are formed when said latch means latches said two portions together, wherein at least one end of the jewelry chain passes freely through said apertures while the lock is engaged by said apertures, the lock being free of attachment to the cap but for the lock being larger than said apertures and unable to pass therethrough.

2. The cap of claim 1 wherein both of said portions include concave elements and wherein said indentations are formed on at least one of said concave elements.

3. The cap of claim 2 wherein both of said portions are formed from at least a portion of a hemisphere.

4. The cap of claim 3 wherein indentations are formed on both of said concave elements and wherein said indentations on said first portion align with indentations on said second portion when said first portion is engaged against said second portion by said latch means.

5. The cap of claim 4 wherein said hinge means is formed on a first end of said first and second portions; said latch means is formed on a second end of said first and second portions; and said indentations are formed on lateral sides of said first and second portions substantially perpendicularly to said hinge means.

6. The cap of claim 5 wherein said latch means includes a pivoted male element on said first portion which engages a slot on said second portion.

7. The cap of claim 6 wherein said pivoted male portion includes a bulbous protrusion.

8. The cap of claim 7 wherein said bulbous protrusion engages a passageway formed by a bridge across an inward section of said slot.

9. The cap of claim 8 wherein said male portion includes an outwardly exposed knurled portion.

10. The cap of claim 5 wherein said latch means comprises a first channel on said first portion, a second channel on said second portion, and a post longitudinally moveable in one of said first or second channels, wherein said first and second channels are offset from each other and form a combined channel when said first portion is engaged against said second portion, and wherein said post in said one of said channels is retractably inserted into the other of said first or second channels when said first portion is engaged against said second channel.

11. The cap of claim 10 wherein said post includes a portion extending through an outer surface of one of said first or second portions.

12. The cap of claim 2 wherein said first portion is substantially planar shaped and said second portion is formed from at least portion of a hemisphere further including said concave element.

13. The cap of claim 12 wherein indentations are formed on said concave element and wherein said indentations on said first portion abut said planar shaped first portion when said first portion is engaged against said second portion by said latch means.

14. The cap of claim 13 wherein said hinge means is formed on a first end of said first and second portions; said latch means is formed on a second end of said first and second portions; and said indentations are formed on lateral sides of said first portion substantially perpendicularly to said hinge means.

15. The cap of claim 14 wherein said latch means includes a detent tab extending from said first portion which engages a detent slot on said second portion.

16. The cap of claim 1 wherein said cap is substantially free of apertures other than said first aperture and said second aperture.

17. The cap of claim 1 substantially free of means of securing the chain to the cap other than by way of the lock with respect to said first and second apertures.

18. In combination:

a jewelry chain with a first end and a second end, said first end including a lock which has a greater diameter than said second end; and a cap for concealing said lock of jewelry chain comprising:

a first and a second portion, wherein at least one portion includes a concave element for encompassing and concealing said lock;

hinge means hingeably attaching a first end of said first and second portions together whereby said cap is releasably detachable from the lock on the jewelry chain;

latch means on a second end of said first and second portions for latching said first and second portions together; and at least one of said first and second portions including indentations whereby a first aperture and a second aperture are formed when said latch means latches said two portions together, said first aperture and said second aperture being smaller in diameter than said first end of said chain and larger in diameter than said second end of said chain whereby said first end is engaged by said first aperture and said second end passes freely through said second aperture, the lock being free of attachment to the cap but for said first end of said chain being larger than said apertures and unable to pass therethrough.

19. The combination of claim 18 wherein said cap is substantially free of apertures other than said first aperture and second aperture.

20. The combination of claim 18 wherein said chain is substantially free of means of securing with said cap other than by way of said lock with respect to said first and second apertures.

* * * * *